United States Patent [19]

Luderer

[11] 4,322,038

[45] Mar. 30, 1982

[54] ELECTROSTATIC PAINT SPRAY PISTOL WITH A ROTATING BELL SHAPED ATOMIZER

[75] Inventor: Manfred Luderer, Leutenbach, Fed. Rep. of Germany

[73] Assignee: Ernst Mueller GmbH & Co., Winnenden-Hoefen, Fed. Rep. of Germany

[21] Appl. No.: 102,862

[22] Filed: Dec. 12, 1979

[30] Foreign Application Priority Data

Dec. 15, 1978 [DE] Fed. Rep. of Germany ..... 2854326

[51] Int. Cl.[3] ..... B05B 5/00

[52] U.S. Cl. ..... 239/700

[58] Field of Search ..... 239/699, 700, 701, 702, 239/703, 223, 224; 118/626

[56] References Cited

U.S. PATENT DOCUMENTS 3,083,911 4/1963 Griffiths ..... 239/703

3,233,580 2/1966 Levake ..... 239/223 X

*Primary Examiner*—Robert B. Reeves

*Assistant Examiner*—Gene A. Church

*Attorney, Agent, or Firm*—Laurence R. Brown

[57] ABSTRACT

An electrostatic paint spray pistol with a rotary bell shaped atomizer head is provided with a bell rim in the shape of a rounded circular arch from which paint may be centrifuged at various positions. This produces the advantage of being able to control rotating speed and paint throughput over a wide range.

High rotating speed of the bell is attained by an air motor in a manner such that the air flow does not interfere with the electrostatic precipitation action of the centrifuged paint.

The electric field position on the bell does not need to emanate from the same position at which the paint is centrifuged off the rounded bell rim.

3 Claims, 2 Drawing Figures

ELECTROSTATIC PAINT SPRAY PISTOL WITH A ROTATING BELL SHAPED ATOMIZER

Figure 1:
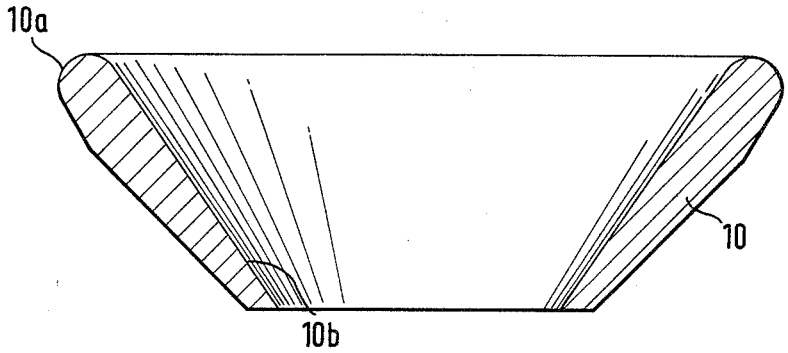

This invention relates to an electrostatic paint spray pistol with a rotating bell shaped atomizer in which the paint is distributed in a thin film on the inner bell surface and is centrifuged from the rim of the bell.

The paint spray pistol art has long been known. However, therein the rim of the bell is made sharp as a knife, because of the assumption that a stationary electrostatic atomization and downward flow to the goods to be painted is only assured when the electrode as well as the edge of the bell has a sharp edge and when the electrode edge and centrifuge edge coincide. This art typically works with a rotation speed of about 1000 revolutions per minute and produces a very good flow characteristic.

One disadvantage of this art occurs in that the paint throughput is deficient, for example, in an electrostatic pressurized air centrifugal pistol, that is with higher paint throughput the distribution quality significantly decreases. A mere increase of the rotation speed of the bell will not improve this deficiency.

Better results can only be attained if the presumption is removed that electrode edges and centrifugal edges must coincide. Thus, German PS No. 12 40 764 discloses a rotating centrifugal feed wherein the electrode edge and the centrifugal edge are separated from each other in such a way that the paint only reaches the outgoing electric field extending from the separate electrode edge after leaving the centrifuge edge.

With these precautions, the insertion of an air spray producing a helping air stream and increasing the rotational speed to over 20,000 revolutions per minute is possible to substantially increase the paint throughput without creating a corresponding decrease of the atomizing quality. Also the feared air inclusion with the outwardly flowing paint film toward the workpiece can in this way be avoided. A construction employing this same principle of a higher speed atomizer bell at a later date is disclosed in German Off ESS OS No. 26 59 428.

Also the above mentioned fast rotating atomizer bell with separated from each other centrifuge and electrode edges nevertheless shows a disadvantage, namely that a particular atomizer bell will have a definite optimum paint throughput flow, that is to say, the location of the two edges respectively and their distance from each other requires a particular paint throughput. Then it is quite obvious that when the two edges are very close to each other, it follows that too high a paint throughput results in some kind of splashing of the paint over the centrifuge edge.

Accordingly, it is an object of this invention to improve the desirable rotating atomizer bells of the prior art, so that different paint throughputs assure a satisfactory atomization and deposit of the paint without air intrusion.

This object is achieved in accordance with this invention by the knowledge obtained during many tests that the electrode edges and centrifuge edges are not (as is well known) required to be separated from each other but rather beyond that it is not necessary that the electrode and the centrifuge position have sharp edges. The achievement of this objective depends upon the discovery that the bell rim in cross section has a shape that includes a substantially 180° radial circular arch whose diameter is at least 1 mm.

In accordance with a preferred embodiment of the invention, an atomizer bell is employed in which an air source produces an auxiliary air stream to attain a rotational speed in the order of 30,000 revolutions per minute and in which the diameter of the bell rim circular arch is between 2 and 10 mm and preferably between 4 and 8 mm.

Also in accordance with the invention a rounder and considerably thicker bell rim is provided. Tests have shown that over a very large range of throughputs a very good atomization is achieved and especially that the paint layer is deposited on the workpiece essentially without inclusion of air. The reason for this may be that the paint so to speak seeks the optimum centrifuge position. Consequently for example the increase of the throughput of the paint when employing the rounder thicker bell rim permits it to creep out further until it leaves the bell rim when the higher centrifuge power desirable for good atomization is reached. Likewise it has been shown that the influence of the electrostatic field during the absence of a sharp edged electrode is in no way detrimental.

Embodiments of the invention are set forth in the drawing, which show:

FIG. 1 a cross section through an atomizer bell, and

Figure 2:
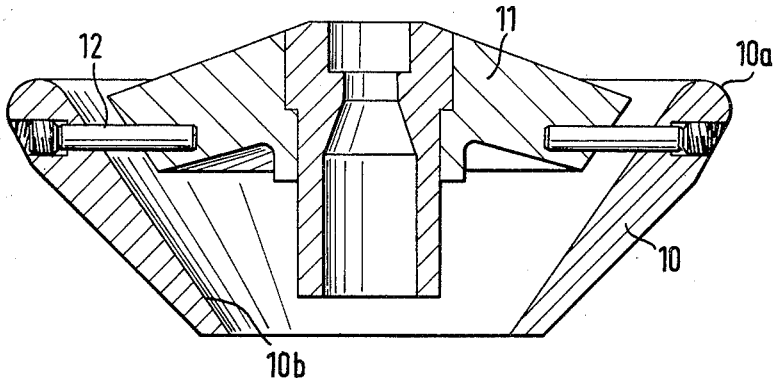

FIG. 2 a cross section through an atomizer bell with a cover disc.

FIG. 1 shows a cross section through an atomizer bell 10, whose rim edge 10*a* has the shape of a circular arch with a radial span angle of about 180°. The view is about on a scale of one to one. This bell can be made from metal and is attached in a known manner to the rotary driveshaft of a spray pistol. Similarly in a known fashion the bell is connected to a high voltage conductor and on its inner face 10*b* is covered with paint.

The paint spray pitsol (not shown) is in like conventional manner connected with an air supply, which produces an auxiliary air stream in a spray direction oriented from behind toward the atomizer head and accordingly assists the turnaround of the paint droplets toward the workpiece. The rotation speed is in the order of magnitude of 30,000 revolutions per minute.

In FIG. 2 is shown a second embodiment of the atomizer bell. This bell is distinguished slightly from that of FIG. 1 in that it has a known cover disc 11, which is affixed to the bell 10 by means of bolts 12. It is essential in this embodiment that the fastening bolts 12 are not positioned adjacent the bell rim 10*a* but are offset therefrom and are properly streamlined, being in cross section round, oval or droplet shaped.

Also, it is seen that the advantage of the rounded bell rim would be destroyed if these fastening bolts 12 in the manner most customary are in the plane of the bell rim 10*a* and/or are sharp edged. It is clear that such fastening elements upset the symmetrical inflow of the paint to the rounded bell rim or even react in eddy current fashion. In other words, the paint about the bell rim 10*a* must be continuous in shape in order to produce an even homogeneous layer.

I claim:

1. An electrostatic paint pistol comprising in combination, a rotatable atomizer bell for dispensing paint from a thin film on its inner surface by centrifuging from the rim of the bell, a rounded bell rim providing a surface from which paint is centrifuged at different positions for different paint throughput rates having a generally circular arch shape in cross section with a diameter greater than one mm and rounded electrode surface means for establishing an effective electrical field position on the rotatable rounded bell rim which does not coincide with the position from which the paint is centrifuged at said different throughput rates.

2. The combination defined in claim 1 wherein the circular arch has a diameter between 4 and 8 mm.

3. The combination defined in claim 1 including means rotating the atomizer bell in the order of 30,000 revolutions per minute.

* * * * *